United States Patent [19]

Hornberg et al.

[11] 4,297,044

[45] Oct. 27, 1981

[54] ADDITIONAL ATTACHMENT FOR ALL TYPES OF KEY OPERATED MACHINES

[75] Inventors: Harald Hornberg, Berlin; Günter Trotzek; Fedor Hahnefeld, both of Unterhaching, all of Fed. Rep. of Germany

[73] Assignee: H. Berthold Aktiengesellschaft, Fed. Rep. of Germany

[21] Appl. No.: 37,045

[22] Filed: May 8, 1979

[30] Foreign Application Priority Data

May 8, 1978 [DE] Fed. Rep. of Germany ..... 2820422

[51] Int. Cl.[3] ..... B41J 5/08

[52] U.S. Cl. ..... 400/473; 235/146

[58] Field of Search ..... 400/472–476, 400/489; 235/145 R, 146; 340/365 VL; 178/17 C; 35/5

[56] References Cited

U.S. PATENT DOCUMENTS

| | | | |
|---|---|---|---|
| 630,847 | 8/1899 | Bofinger | 400/473 X |
| 3,747,735 | 7/1973 | Frick | 400/473 X |
| 4,020,328 | 4/1977 | Bradam | 235/146 |
| 4,158,130 | 6/1979 | Speraw et al. | 235/145 R X |

*Primary Examiner*—Paul T. Sewell

*Attorney, Agent, or Firm*—Basile, Weintraub & Hanlon

[57] ABSTRACT

Additional attachment for key operated machines comprises a frame which covers the keyboard and which holds the desired entire number of symbols. The frame has the shape of a perforated plate which is fixed to the keyboard. Additional keys are located in the perforations of the plate and are in alignment with the keys of the key operated machine. The cover plate is placed in a detachable manner on the surface of the perforated plate. The cover plate is perforated in agreement with the perforations of the first plate and is equipped with the desired symbols.

6 Claims, 2 Drawing Figures

ADDITIONAL ATTACHMENT FOR ALL TYPES OF KEY OPERATED MACHINES

BACKGROUND OF THE INVENTION

1. Field of the Invention

The present invention is concerned with an additional attachment for key operated machines.

2. Description of the Prior Art

There exists a broad range of applications for key boards such as the generally wide spread use of the normal keyboard of typewriters and of accounting machines or, however, in the graphic field of the keyboards of photo typesetting machines, linotype machines or the keyboards of correction equipment or display units with a screen which are equipped with further keys for special symbols in addition to the normal keyboard.

These pieces of equipment have in common that letters, numbers, characters or other symbols should visibly be generated using the keyboard by means of various methods or that it should at least be possible to store the letters, numbers, characters or other symbols for further use. Often it is necessary to be able to generate characters with the same piece of equipment which deviate from the characters which are shown on the keys in order to be able for instance, to put in another language such as for instance Greek or Cyrillic or mathematic symbols or even music notes. It can be necessary for the type setting of a photo typesetting machine that a text must be typeset in several languages or in the middle of a normal typesetting word, lines appear in a foreign language which necessitates a corresponding adaptation of the keyboard. This results in a situation that appropriate additional key boards or complete machines of a different type with another keyboard must be available.

One of the most simple additional attachments for the changing of the keyboard covers consists in the pushing or capping respectively of appropriately different marked caps over the individual keys. Furthermore, there are also known so called "flexible covers" which consist of a frame which encompasses the group of keys over which frame a thin flexible membrane is stretched on which membrane pictures of the new symbols are attached in alignment with the keys which are located below these symbols (DF-AS No. 2532762, DT-GM No. 7105085, U.S. Pat. No. 2625330).

These flexible cover areas have the disadvantage that it is almost impossible to prevent an unintended pushing of an adjacent key that was not desired or the unintended pushing of a key can only be prevented if the operator observes the keyboard with a lot of care. In this way there results another disadvantage which is that the skilled operator is not able to write without looking at the original since he cannot feel the contours of the individual keys to which he is used to and therefore he does not know where his fingers are located. Therefore, he is forced to pay a great deal of attention to the keyboard in addition to the text which should be transcribed.

Furthermore, keyboard colors are known which consist of a solid lattice frame which surrounds the individual keys, where each individual row of keys is colored with a flexible tape (DT-PS No. 1277873, DT-PS No. 1955583). Here again the result is that the operator does not have sufficient finger contact with the actual keyboard. Furthermore, the flexible material results in a momentum of forces which must be overcome in addition to the missing keys which is fatiguing for the operator in the long run.

SUMMARY OF THE INVENTION

The invention is based on the objective to create an additional attachment of the type which is described in the specification part of the main claim which should cover the existing keyboard in a simple, rapid and shift-free manner and which should give the operator a high degree of sensible and perceptible sameness of contourness in comparison to the keyboard which is located below and which the operator is used to in such a way that a rapid and sure and secure use of the equipment is assured as it would be expected from the original keyboard.

In accordance with the invention this problem is solved by means of an additional attachment such as it is defined by the characteristics as they are stated in the main claim.

Advantageous further modifications, developments and refinements of the solution to this problem results and are shown in the sub-claims.

The automatic centering effect in the placement in a fixed position which results solely and already by placement of the device onto the keyboard does not necessitate any special means of attachment. It is of a special advantage to use individual keys which are placed on top of each original key and which are supported and guided by two perforated plates which are mechanically connected in such a way that the key of the existing original keyboard which is always located below can be used just by feeling in an identical manner. The individual keys consist of very light material (light by weight) and are placed upon and contact the existing keys in a self-centering manner. In this way, it is also not necessary to use any additional spring force for the raising of the keys. This has a positive effect with regard to signs of fatigue in case of extended use of these devices.

Modern key operated machines and equipment such as for instance, typewriters, accounting machines or typesetting machines have keyboards where the raising height is only very small due to the fact that each key is switched electrically and therefore the lifting height of the keys is very small. Since mechanical movements do not have to be performed in this case accordingly there results also a very small structural height of the additional attachment to the keyboard.

In case of the present version of the invention it is furthermore of advantage not to equip the keyheads of the covering additional attachment with the new characters or symbols but rather to attach these new characters or symbols onto an inexpensive plate or foil which can readily be manufactured and which plate or foil is equipped with perforations of the type of a perforated plate which correspond with the keys and which plate or foil can be placed over the keys and onto the additional attachment and which therefore can be exchanged in any way independent of the actual additional attachment.

In this way there exists the great advantage that in case of any change of the keyboard, the entire attachment does not have to be exchanged with another attachment which is equipped with other symbols but rather only the plate or foil or similar material on which the characters are placed has to be exchanged. Of course, in addition to this possibility of exchange it is also possible to equip the individual keys of the additional attachment to the key board with the desired characters or symbols and to exchange these keys if that should be desired.

It is another advantage that the keyheads of the cover have a physical shape which corresponds to the keyboard which are normally used such that the operator with normal skill can feel the desired keys as usual with his fingertips and therefore the operator can type without loss of typewriter speed. This is also true for typing without looking at the keyboard.

DESCRIPTION OF THE DRAWING

The invention is explained and illustrated in the description below by using the examples of versions of the invention as shown. The following is shown.

DESCRIPTION OF THE PREFERRED EMBODIMENTS

Figure 1:
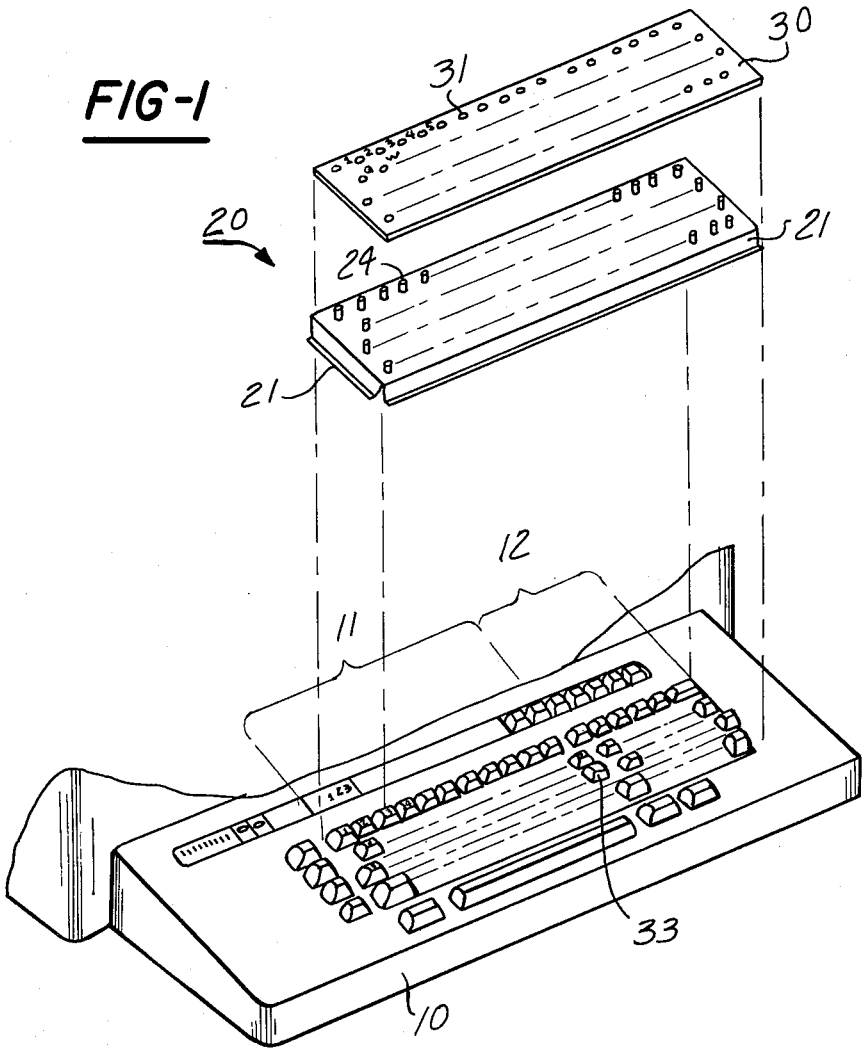
FIG. 1, is a perspective, exploded view of the device in connection with the key board of a photo typesetting input device. and, FIG. 2 is a cross section of the additional attachment.

As shown in FIG. 1, the additional attachment 20 consists substantially of two parts, that is, of a reverse tray-shaped plate 21 and of a cover plate 30. The additional attachment 20 is placed on top of the keyboard of, in this case, the input equipment 10 of a photo typesetting equipment which is not shown. The plate 21 of the additional attachment 20 can cover the entirety of the keyboard of the keyboard operated machine or in case this is desired in the individual case, it can be fastened in such a way that only partial areas 11 or 12 are covered by this additional attachment. In case of an example of a version of the invention for a photo typesetting machine, the partial area 11 of the total keyboard field represents the actual normal keyboard; whereas the partial area 12 includes special typographical characters such as accents, line elements, fractions or other typesetting orders of all kinds. In this case, both partial areas 11 and 12 are adapted to the adaptation requirements of different users or possibilities of use respectively, in such a way that the plate 21 covers the entire keyboard field.

Figure 2:
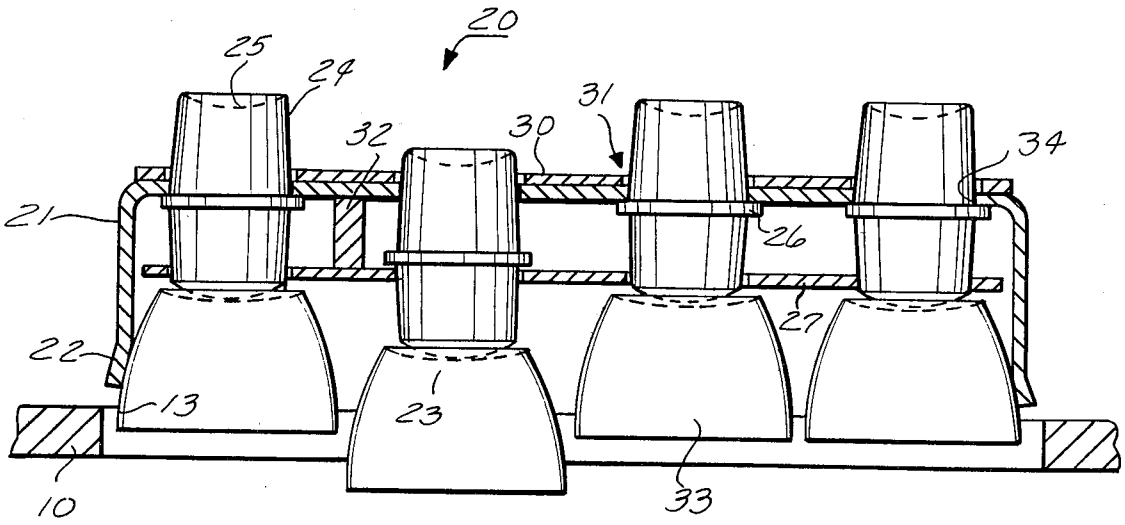

The view of a cross section of the additional attachment 20 in FIG. 2 shows further details of its construction and especially this figure should be referred in the text below.

The plate 21 which is, in the example of the version of the invention, a simple stamping part made out of sheet metal consisting in this case of an upper perforated area which is perforated in accordance with the arrangement with the keys 33 of the input station 10 of the photo typesetting equipment. The perforated area is bent in a right angle following the edges of its four sides and is again bent sloping to the outside in the lower edge area with reference to this elevation which extends in a right angle with reference to the cover area in such a way that a guiding lip 22 results in this place. The perforations 34 which are located in the plate 21 in alignment above the keys 33 of the input station 10, serve to receive the keys 24 which are inserted in these perforations 34 in a freely movable manner and which are prevented from falling out by means of a torus which is located approximately in the middle and the radial size of which torus is larger than the size of the perforations 34 in the plate 21. The movement of the individual keys 24 in a downward direction, that is during the typing and during the pushing in of each individual key 24 in a downward direction, moves the original keys 33 through a perforated plate 27 which is located parallel with reference to the upper area of the plate 21 and which is fixed into place by means of spacing bolts 32. The torus 26 which is shaped like a flange prevents the falling out of the keys 24 when the plate is removed. The pattern of perforations in the perforated plate 27 is in agreement and in conformity with the pattern of perforations in the plate 21 and it is in alignment with the pattern of perforations in the plate 21 and therefore in alignment with the keys 33 of the input equipment 10 of the photo typesetting equipment.

Therefore, the keys 24 are automatically centered with reference to the keys 33 because of the fact that their frontal area is located in contact with the surface of the keys since they are curved or vaulted in a convex fashion as viewed from below where this curvature engages in the spherical indentations which are anyhow part of the original keyboard 33. The spherical indentations in the keys of the keyboard to which the operator is used to are repeated in the shape of the indentations 25 in the upper frontal area of the keys 24 which are contacted by the fingers of the operator. The physical shape of the indentations 25 is to a great extent, similar to the physical shape of the above-mentioned indentations and preferrably they are identical with these.

In addition to the physical shape of the keys 24 and their automatic centering on the surfaces of the keys 33, it is significant for the shaping of the additional attachment 20 that the plate 21 is automatically fixed in place on the original keyboard on the input station 10 by means of the guiding lips 22 which were mentioned above. When the additional attachment is put into place this lip 22 contacts the outer edges 13 of the keys 33 which are generally shaped in such a way that they are tapered towards the top in the shape of a truncated cone or a truncated pyramid.

This results in a secure and rapid placing of the additional attachment 20 and, at the same time, tolerances, which are possibly present, are compensated after the additional attachment 23 has been placed and automatically set and centered by means of the guiding lips 22. The individual keys 24 will be centered automatically due to the frontal areas 23 which are shaped in the shape of a circular segment or which are curved and shaped in a convex fashion.

The keys 24 consist of a material of low density such as, for instance, a light thermoplastic material such that the load which is in this way placed on the original keys 33 of the input station 10 or of any other keyboard operated machine due to the own weight of the keys 24 is so small that it can be neglected or can almost be neglected respectively.

The free movement of the keys 24 between the cover area of the plate 21 and the perforated plate 27 is therefore not influenced by additional forces nor is it influenced by additional return momentum.

An additional perforated cover plate 30 is now placed onto the upper area of the plate 21 in agreement and conformity with the keyboard 24. The perforations 31 of the cover plate 30 permit a movement of the keys 24 which is without friction. This cover plate 30 is the actual supporting element on which the keys 24 and therefore the lower lying keys 33 with the appropriate symbols and characters as indicated by FIG. 1, next to the perforations 31 which is distinctly visible on the cover plate 30 are placed. The cover plate 30 supports itself due to the keys 24 which extend through it in such a way that additional measures of attachment onto the plate 21 do not have to be taken for the purpose of the exchange of the characters for the keys 33 and therefore, correspondingly, the keys 34 for instance due to a change from one language to another language with other types of letters now only the cover plate 30 has to be exchanged which cover plate 30 corresponds then with its different symbols with the appropriate arrangement or rearrangement of the keyboard operated machine. It is also possible that the cover plate is not already equipped with the characters and symbols which should be used in each case by means of fronting or in any other way but rather that its surface is shaped in such a way that the operator can mark the keys himself, that is, he can attach certain characters or symbols to the keys. The cover plate 30 can consist of inexpensive thin paper or an aluminum foil or of film material or similar materials.

As a variation of this possibility, there are cases of applications conceived where the cover plate 30 is hindering something or in the way or it is not desirable. In this case, the cover plate 30 can be omitted if the individual keys 24 with the appropriate symbols are exchanged which can be arranged with justifiable work effort by removal of the additional attachment 30 and removal of the perforated plate 27 from the plate 21.

What is claimed is as follows:

1. Additional attachment for machines operated by a first set of keys disposed in a keyboard comprising:

a frame, said frame covering said keyboard;

said frame having the shape of a first plate, said first plate including a plurality of perforations, said perforations being aligned with said keys of said first set of keys in said keyboard, said first plate being a solid plate with side and edge areas, complementary to outer edges of said first set of keys, said side and edge areas abutting the outer edges of the rows of said first set of keys which form the boundaries of said keyboard, to vertically support the attachment solely by said abutment, said side and edge areas aligning said attachment with said first set of keys;

a second set of keys, said second set of keys being disposed in said perforations in said first plate;

and a second plate disposed in a detachable manner on the surface of said first plate, said second plate including a plurality of perforations in agreement and conformity with said perforations in said first plate, said second plate carrying the symbols associated with each of said keys in said second set of keys.

2. The additional attachment in accordance with claim 1 further including:

a third plate disposed in parallel with and spaced at a distance below the area of the first plate which is covered by the second plate, said third plate including a plurality of perforations located in alignment with the perforations in the first plate; and a torus affixed to each key of the second set of keys such that said torus is disposed in the area between the perforations of said first plate and the perforations of said third plate when the keys are disposed in the perforations to prevent the falling out of said keys of said second set of keys from said perforations.

3. The additional attachment in accordance with claim 1 wherein the keys of the second set of keys are equipped with a convex frontal area, said convex frontal area being placed onto and in engagement with the spherical indentation of the keys of the first set of keys so as to enable automatic centering of said keys of said second set of keys in said first set of keys.

4. The additional attachment in accordance with claim 1 wherein the keys of the second set of keys are equipped with an upper frontal area with a spherical indentation, said upper frontal area being acted upon by the finger pressure of the operator and which upper frontal area is in agreement and conformity with the indentation of the keys of the keyboard.

5. The additional attachment in accordance with claim 1 wherein the symbols are permanently attached adjacent to the keys of the second set of keys on the second plate.

6. The additional attachment in accordance with claim 1 wherein the symbols are permanently attached on the upper frontal area of each of the keys of the second set of keys.

* * * * *